US009495907B2

(12) United States Patent
Han

(10) Patent No.: US 9,495,907 B2
(45) Date of Patent: Nov. 15, 2016

(54) PIXEL DRIVING CIRCUIT AND PIXEL DRIVING METHOD OF ORGANIC LIGHT-EMITTING DIODE

(71) Applicant: Shenzhen China Star Optoelectronics Technology Co., Ltd., Shenzhen, Guangdong (CN)

(72) Inventor: Baixiang Han, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 145 days.

(21) Appl. No.: 14/381,901

(22) PCT Filed: Jul. 2, 2014

(86) PCT No.: PCT/CN2014/081440

§ 371 (c)(1),
(2) Date: Aug. 28, 2014

(87) PCT Pub. No.: WO2015/192399

PCT Pub. Date: Dec. 23, 2015

(65) Prior Publication Data

US 2016/0240136 A1 Aug. 18, 2016

(30) Foreign Application Priority Data

Jun. 16, 2014 (CN) ..... 2014 1 0268620

(51) Int. Cl.
*G09G 3/3233* (2016.01)
*G09G 3/32* (2016.01)

(52) U.S. Cl.
CPC .... *G09G 3/3233* (2013.01); *G09G 2300/0819* (2013.01); *G09G 2300/0842* (2013.01); *G09G 2320/045* (2013.01)

(58) Field of Classification Search
CPC ..... G09G 3/3233; G09G 2320/045; G09G 2300/0819; G09G 2300/0842
See application file for complete search history.

(56) References Cited

U.S. PATENT DOCUMENTS

2006/0151745 A1* 7/2006 Kim ..... G09G 3/325 252/301.16
2011/0141000 A1* 6/2011 Han ..... G09G 3/3233 345/82
2013/0169516 A1* 7/2013 Chen ..... G09G 3/3258 345/76
2014/0014912 A1* 1/2014 Kim ..... H01L 27/3276 257/40
2014/0027719 A1* 1/2014 Kim ..... H05B 33/0896 257/40
2014/0071176 A1* 3/2014 Kim ..... G09G 3/3225 345/690
2014/0098083 A1* 4/2014 Lee ..... G09G 3/3291 345/213

* cited by examiner

*Primary Examiner* — Lun-Yi Lao
*Assistant Examiner* — Kelly B Hegarty
(74) *Attorney, Agent, or Firm* — Andrew C. Cheng

(57) ABSTRACT

The present invention provides a pixel driving circuit and a pixel driving method of an organic light emitting diode, the pixel driving circuit comprises: a first transistor (T1), a second transistor (T2), a third transistor (T3), a fourth transistor (T4), a fifth transistor (T5), a sixth transistor (T6), a storage capacitor (C1) and an organic light-emitting diode (OLED); which also comprises a scanning control terminal (Scan), a data signal terminal (Data), a constant current source (Iref), a control light emitting signal terminal (Em), a power supply voltage (VDD) and a power supply negative electrode (VSS); the first transistor (T1) is a driving transistor. The present invention uses 6T1C compensation circuit to compensate the threshold voltage of the driving transistor of each pixel, grabbing the threshold voltage through the constant current source, and the data writing and the threshold voltage (Vth) grabbing are simultaneous, which effectively compensate the threshold voltage (Vth) variation of the driving transistor, improving the display quality.

11 Claims, 6 Drawing Sheets

| Data(V)' | Vth1'= -0.8V | Vth2'= -0.3V | % | Vth3'= -1.3V | % |
|---|---|---|---|---|---|
| | $I_{OLED}1'$ | $I_{OLED}2'$ | $\Delta I_{OLED}2'$ | $I_{OLED}3'$ | $\Delta I_{OLED}3'$ |
| 4.10 | 1.00E-10 | 3.00E-09 | 2900.00% | 2.00E-11 | 80.00% |
| 3.78 | 1.04E-09 | 1.31E-08 | 1163.46% | 2.00E-11 | 98.08% |
| 3.33 | 1.07E-08 | 5.69E-08 | 430.38% | 7.40E-10 | 93.10% |
| 2.60 | 1.01E-07 | 2.69E-07 | 166.09% | 2.52E-08 | 75.07% |
| 1.68 | 5.00E-07 | 8.91E-07 | 78.28% | 2.34E-07 | 53.16% |
| 1.06 | 1.00E-06 | 1.54E-06 | 53.06% | 5.85E-07 | 41.67% |

Fig. 2

| Data(V) | Vth1= -0.8V | Vth2= -0.3V | % | Vth3= -1.3V | % |
|---|---|---|---|---|---|
| | $I_{OLED}1$ | $I_{OLED}2$ | $\Delta I_{OLED}2$ | $I_{OLED}3$ | $\Delta I_{OLED}3$ |
| 4.40 | 1.00E-10 | 1.20E-10 | 20.00% | 9.00E-11 | 10.00% |
| 4.10 | 1.21E-09 | 1.37E-09 | 13.22% | 1.17E-09 | 3.31% |
| 3.65 | 1.17E-08 | 1.27E-08 | 7.75% | 1.15E-08 | 2.30% |
| 2.90 | 1.03E-07 | 1.07E-07 | 3.84% | 1.01E-07 | 1.37% |
| 1.72 | 5.06E-07 | 5.17E-07 | 2.28% | 4.98E-07 | 1.45% |
| 0.50 | 1.01E-06 | 1.04E-06 | 2.21% | 1.01E-06 | -0.13% |

Fig. 5

PIXEL DRIVING CIRCUIT AND PIXEL DRIVING METHOD OF ORGANIC LIGHT-EMITTING DIODE

BACKGROUND OF THE INVENTION

1. Field of the Invention

The present invention relates to the display technical field, and in particular to a pixel driving circuit and a pixel driving method of an organic light-emitting diode.

2. The Related Arts

As a new generation of display technology, active matrix/organic light-emitting diode, AMOLED, has advantages of High brightness, wide color gamut, a wide viewing angle, fast response, small size, etc. the light emitting device of AMOLED is organic light-emitting diode, OLED, under AMOLED driving circuit driving, when the current flows through the OLED, the OLED lights up. AMOLED is a current driven device, the brightness is decided by the current size flowing through the OLED, most of the existing integrated circuit, IC, only transmit the voltage signal; therefore, AMOLED pixel circuit usually adopts 2T1C V/I conversion circuit to transfer the voltage signal to the current signal.

Please refer to FIG. 1 which is a traditional 2T1C V/I conversion circuit. It comprises a switching transistor (T1'), a driving transistor (T2'), a storage capacitor (C1') and an organic light emitting diode (OLED'); it also comprises a scanning control terminal (Scan'), a data signal terminal (Data'), a power supply voltage (VDD') and a power supply negative electrode (VSS'); the switching transistor (T1') comprises a first gate (g1'), a first source (s1') and a first drain (d1'), the driving transistor (T2') comprises a second gate (g2'), a second source (s2') and a second drain (d2'); the first gate (g1') is electrically connected with the scanning control terminal (Scan'), the first source (s1') is electrically connected with the data signal terminal (Data'), the first drain (d1') is electrically connected with the second gate (g2') and the lower plate of the storage capacitor (C1'); the power supply voltage (VDD') is electrically connected with the upper plate of the storage capacitor (C1') and the second source (s2'); the anode of the organic light emitting diode (OLED') is electrically connected with the second drain (d2'), the cathode of the organic light emitting diode (OLED') is electrically connected with the power supply negative electrode (VSS'). The driving transistor (T2') is used to make sure the driving current of AMOLED panel driving circuit, the organic light emitting diode (OLED') is used to response the driving current to light up and display; the storage capacitor (C1') mainly stores the gray scale voltage signal output by the data signal terminal (Data'), the driving current size of the driving transistor (T2') is decided by the gray scale voltage stored in the storage capacitor (C1'); the switching transistor (T1') and the driving transistor (T2') are thin film transistors, TFT.

Please refer to FIG. 2 and combine FIG. 1, which is the traditional 2T1C V/I conversion circuit simulation data sheet, wherein Vth' is the threshold voltage, $I_{OLED}'$ is the current flowing through the organic light emitting diode (OLED'), $\Delta I_{OLED}'$ is the current drift rate flowing through the organic light emitting diode (OLED'): $\Delta I_{OLED}2'=(I_{OLED}2'-I_{OLED}1')/I_{OLED}1'$, $\Delta I_{OLED}3'=(I_{OLED}3'-I_{OLED}1')/I_{OLED}1'$. According to the simulated date in FIG. 2 shows that the threshold voltage (Vth) of the driving transistor drifts, the current variation is too large, the circuit fails.

Therefore, this simply designed pixel is sensitive to the threshold voltage (Vth) of the thin film transistor, the channel mobility, the startup voltage of the OLED, the quantum efficiency and the transient of the power supply. Since the threshold voltage of the driving transistor (T2') will drift with the working time, thus resulting the emitting instability of the organic light emitting diode (OLED'); otherwise, since the existence of the leakage current of the switching transistor (T1'), it makes the voltage of the storage capacitor (C1') unstable, thus resulting the emitting instability of the organic light emitting diode (OLED'), too. Moreover, since the drift of the threshold voltage of the driving transistor (T2') of each pixel is different, increasing or decreasing, it makes the luminous between each pixel is uneven. Therefore, using such 2T1C pixel circuit without compensation, the unevenness of the AMOLED brightness is about 50% or greater.

One way to solve the unevenness is to add the compensation circuit to each pixel, the compensation means that it must compensate the driving thin film transistor parameters (such as threshold voltage and mobility) of each of pixels, making the output current is independent of this parameters.

SUMMARY OF THE INVENTION

The purpose of the present invention is to provide a pixel driving circuit of an organic light emitting diode, which effectively compensates the threshold voltage variation of the driving transistor, improving the display quality.

The other purpose of the present invention is to provide a pixel driving method of and organic light emitting diode, which effectively compensates the unevenness caused by the threshold voltage variation of the driving transistor, ensuring the luminous stability of the organic light emitting diode.

In order to achieving the above purpose, the present invention provides a pixel driving circuit of an organic light emitting diode, which comprises: a first transistor (T1), a second transistor (T2), a third transistor (T3), a fourth transistor (T4), a fifth transistor (T5), a sixth transistor (T6), a storage capacitor (C1) and an organic light-emitting diode (OLED); which also comprises a scanning control terminal (Scan), a data signal terminal (Data), a constant current source (Iref), a control light emitting signal terminal (Em), a power supply voltage (VDD) and a power supply negative electrode (VSS); the first transistor (T1) is a driving transistor, the first transistor (T1) comprises a first gate (g1), a first source (s1) and a first drain (d1), the second transistor (T2) comprises a second gate (g2), a second source (s2) and a second drain (d2), the third transistor (T3) comprises a third gate (g3), a third source (s3) and a third drain (d3), the fourth transistor (T4) comprises a fourth gate (g4), a fourth source (s4) and a fourth drain (d4), the fifth transistor (T5) comprises a fifth gate (g5), a fifth source (s5) and a fifth drain (d5), the sixth transistor (T6) comprises a sixth gate (g6), a sixth source (s6) and sixth drain (d6);

The fourth gate (g4) is electrically connected with the scanning control terminal (Scan), the fourth drain (d4) is electrically connected with the lower plate of the storage capacitor (C1) and the first gate (g1), the fourth source (s4) is electrically connected with the third drain (d3); the third gate (g3) is electrically connected with the scanning control terminal (Scan), the third source (s3) is electrically connected with the constant current source (Iref); the second gate (g2) is electrically connected with the scanning control terminal (Scan), the second source (s2) is electrically connected with the data signal terminal (Data), the second drain (d2) is electrically connected with the first source (s1) and the fifth drain (d5); the fifth gate (g5) is electrically connected with the control light emitting signal terminal (Em), the power supply voltage (VDD) is electrically connected with the upper plate of the storage capacitor (C1) and the fifth source (s5); the first drain (d1) is electrically connected with the sixth source (s6), the sixth gate (g6) is electrically connected with the control light emitting signal terminal (Em), the sixth drain (d6) is electrically connected with the anode of the organic light-emitting diode (OLED), the cathode of the organic light-emitting diode (OLED) is electrically connected with the power supply negative electrode (VSS).

The data writing and the threshold voltage (Vth) grabbing are simultaneous;

The threshold voltage (Vth) grabbing is achieved by constant current source (Iref);

Using the constant current source (Iref) to compensate the threshold voltage (Vth) variation of the first transistor (T1);

Wherein the first transistor (T1), the second transistor (T2), the third transistor (T3), the fourth transistor (T4), the fifth transistor (T5) and the sixth transistor (T6) are the thin film transistors.

The present invention also provides a pixel driving circuit of an organic light emitting diode, which comprises: a first transistor (T1), a second transistor (T2), a third transistor (T3), a fourth transistor (T4), a fifth transistor (T5), a sixth transistor (T6), a storage capacitor (C1) and an organic light-emitting diode (OLED); which also comprises a scanning control terminal (Scan), a data signal terminal (Data), a constant current source (Iref), a control light emitting signal terminal (Em), a power supply voltage (VDD) and a power supply negative electrode (VSS); the first transistor (T1) is a driving transistor, the first transistor (T1) comprises a first gate (g1), a first source (s1) and a first drain (d1), the second transistor (T2) comprises a second gate (g2), a second source (s2) and a second drain (d2), the third transistor (T3) comprises a third gate (g3), a third source (s3) and a third drain (d3), the fourth transistor (T4) comprises a fourth gate (g4), a fourth source (s4) and a fourth drain (d4), the fifth transistor (T5) comprises a fifth gate (g5), a fifth source (s5) and a fifth drain (d5), the sixth transistor (T6) comprises a sixth gate (g6), a sixth source (s6) and sixth drain (d6);

The fourth gate (g4) is electrically connected with the scanning control terminal (Scan), the fourth drain (d4) is electrically connected with the lower plate of the storage capacitor (C1) and the first gate (g1), the fourth source (s4) is electrically connected with the third drain (d3); the third gate (g3) is electrically connected with the scanning control terminal (Scan), the third source (s3) is electrically connected with the constant current source (Iref); the second gate (g2) is electrically connected with the scanning control terminal (Scan), the second source (s2) is electrically connected with the data signal terminal (Data), the second drain (d2) is electrically connected with the first source (s1) and the fifth drain (d5); the fifth gate (g5) is electrically connected with the control light emitting signal terminal (Em), the power supply voltage (VDD) is electrically connected with the upper plate of the storage capacitor (C1) and the fifth source (s5); the first drain (d1) is electrically connected with the sixth source (s6), the sixth gate (g6) is electrically connected with the control light emitting signal terminal (Em), the sixth drain (d6) is electrically connected with the anode of the organic light-emitting diode (OLED), the cathode of the organic light-emitting diode (OLED) is electrically connected with the power supply negative electrode (VSS).

The data writing and the threshold voltage (Vth) grabbing are simultaneous;

The threshold voltage (Vth) grabbing is achieved by constant current source (Iref);

Using the constant current source (Iref) to compensate the threshold voltage (Vth) variation of the first transistor (T1);

Wherein the first transistor (T1), the second transistor (T2), the third transistor (T3), the fourth transistor (T4), the fifth transistor (T5) and the sixth transistor (T6) are the thin film transistors.

The present invention also provides a pixel driving method of an organic light emitting diode, which comprises:

Step 100, providing a first transistor (T1), a second transistor (T2), a third transistor (T3), a fourth transistor (T4), a fifth transistor (T5), a sixth transistor (T6), a storage capacitor (C1) and an organic light-emitting diode (OLED); the first transistor (T1) is a driving transistor, the first transistor (T1) is electrically connected with the second transistor (T2), the fourth transistor (T4), the fifth transistor (T5), the sixth transistor (T6) and the storage capacitor (C1), the third transistor (T3) is electrically connected with the fourth transistor (T4), the sixth transistor (T6) is electrically connected with the organic light-emitting diode (OLED);

Step 200, also providing a scanning control terminal (Scan), a data signal terminal (Data), a constant current source (Iref), a control light emitting signal terminal (Em), a power supply voltage (VDD) and a power supply negative electrode (VSS); the scanning control terminal (Scan) is respectively connected with the second transistor (T2), the third transistor (T3) and the fourth transistor (T4), the data signal terminal (Data) is electrically connected with the second transistor (T2), the constant current source (Iref) is electrically connected with the third transistor (T3), the control light emitting signal terminal (Em) is respectively connected with the fifth transistor (T5) and the sixth transistor (T6), the power supply voltage (VDD) is electrically connected with the storage capacitor (C1) and the fifth transistor (T5), the power supply negative electrode (VSS) is electrically connected with the organic light-emitting diode (OLED);

Step 300, the signal of the control light emitting signal terminal (Em) is high voltage, the signal of the scanning control terminal (Scan) is low voltage, shorting the first transistor (T1) to become the diode structure;

Step 400, the signal of the control light emitting signal terminal (Em) is low voltage, the signal of the scanning control terminal (Scan) is high voltage, recovering the first transistor (T1) to the thin film transistor structure.

The data writing and the threshold voltage (Vth) grabbing are simultaneous.

The threshold voltage (Vth) grabbing is achieved by constant current source (Iref).

Using the constant current source (Iref) to compensate the threshold voltage (Vth) variation of the first transistor (T1).

The benefits of the present invention are: the present invention provides a pixel driving circuit and a driving method of an organic light emitting diode, which uses 6T1C compensation circuit to compensate the threshold voltage of the driving transistor of each pixel, grabbing the threshold voltage through the constant current source, and the data writing and the threshold voltage (Vth) grabbing are simultaneous, the utilization of the constant current source signal line is helpful to the following panel test, it can be more convenient for defect analysis.

In order to further understand the features and the technical contents of the present invention, please refer to the detailed descriptions and the accompanying drawings of the present invention as below; however, the accompanying drawings are only provided for reference and description, not intended to limit the present invention.

BRIEF DESCRIPTION OF THE DRAWINGS

The following description combines the drawings, through describing in detail the embodiments in the present invention, making the technical solutions and other beneficial effect in the present invention more obvious.

In the drawings,

FIG. 2 is a traditional 2T1C V/I conversion circuit simulated data sheet;

FIG. 5 is a 6T1C compensation circuit simulated data sheet utilized by the present invention.

DETAILED DESCRIPTION OF THE PREFERRED EMBODIMENTS

In order to further illustrate the technical method and its effect utilized by the present invention, the following descriptions combine the preferred embodiments and its accompanying drawings of the present invention.

Figure 1:
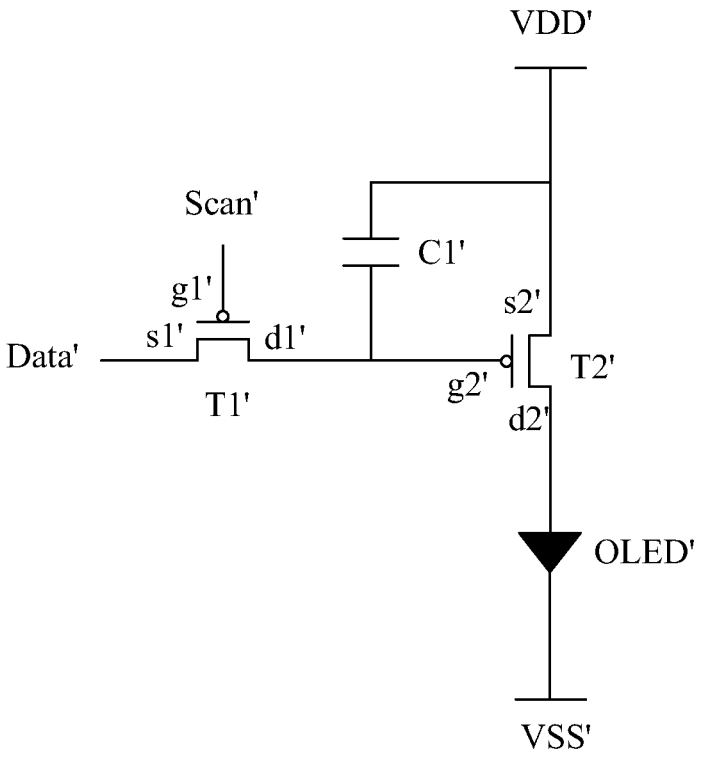
FIG. 1 is a traditional 2T1C V/I conversion circuit diagram.
Figure 3:
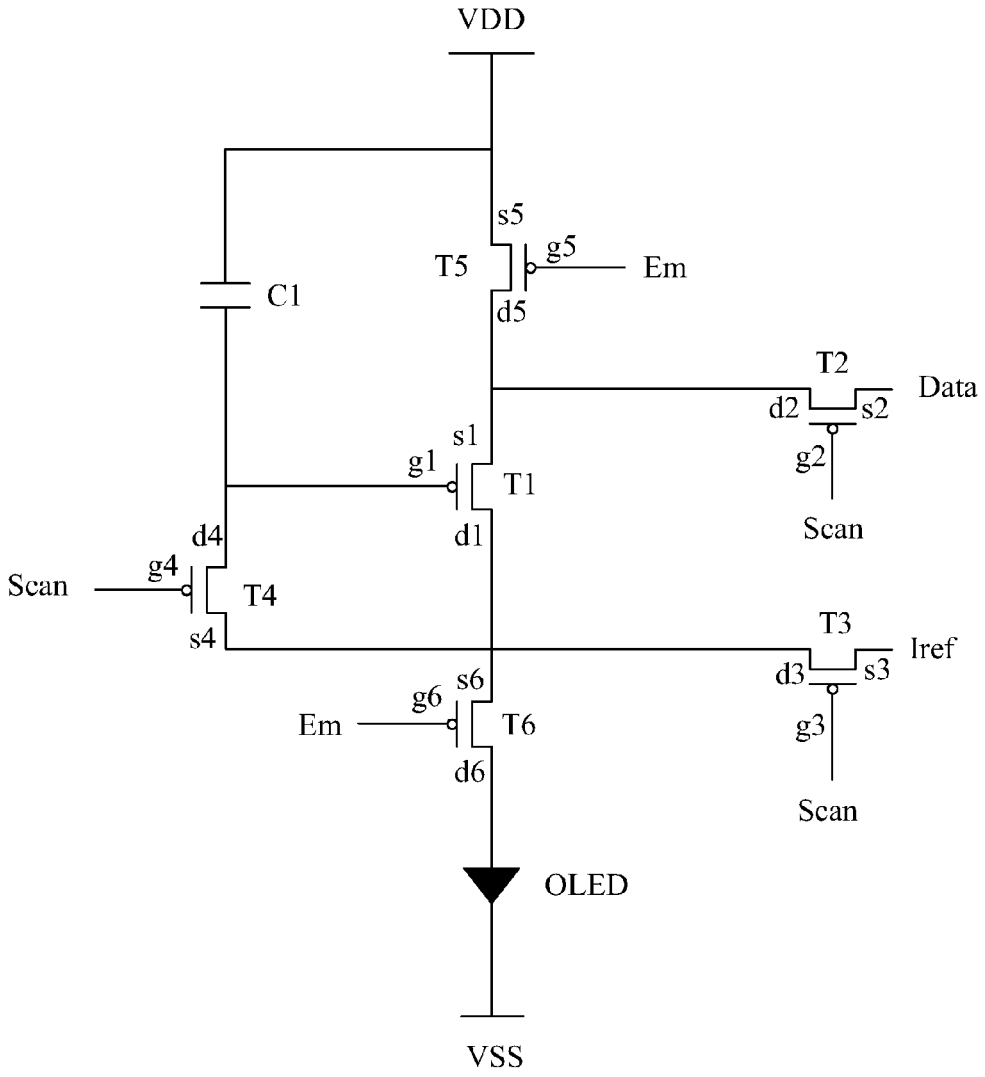
FIG. 3 is a structure diagram of 6T1C compensation circuit utilized by the present invention.

Please refer to FIG. 3, which is a structure diagram of 6T1C compensation circuit utilized by the present invention, take internal compensation circuit of single pixel for example, it comprises a first transistor (T1), a second transistor (T2), a third transistor (T3), a fourth transistor (T4), a fifth transistor (T5), a sixth transistor (T6), a storage capacitor (C1) and an organic light-emitting diode (OLED); which also comprises a scanning control terminal (Scan), a data signal terminal (Data), a constant current source (Iref), a control light emitting signal terminal (Em), a power supply voltage (VDD) and a power supply negative electrode (VSS); the first transistor (T1) is a driving transistor, the first transistor (T1) comprises a first gate (g1), a first source (s1) and a first drain (d1), the second transistor (T2) comprises a second gate (g2), a second source (s2) and a second drain (d2), the third transistor (T3) comprises a third gate (g3), a third source (s3) and a third drain (d3), the fourth transistor (T4) comprises a fourth gate (g4), a fourth source (s4) and a fourth drain (d4), the fifth transistor (T5) comprises a fifth gate (g5), a fifth source (s5) and a fifth drain (d5), the sixth transistor (T6) comprises a sixth gate (g6), a sixth source (s6) and sixth drain (d6);

The fourth gate (g4) is electrically connected with the scanning control terminal (Scan), the fourth drain (d4) is electrically connected with the lower plate of the storage capacitor (C1) and the first gate (g1), the fourth source (s4) is electrically connected with the third drain (d3); the third gate (g3) is electrically connected with the scanning control terminal (Scan), the third source (s3) is electrically connected with the constant current source (Iref); the second gate (g2) is electrically connected with the scanning control terminal (Scan), the second source (s2) is electrically connected with the data signal terminal (Data), the second drain (d2) is electrically connected with the first source (s1) and the fifth drain (d5); the fifth gate (g5) is electrically connected with the control light emitting signal terminal (Em), the power supply voltage (VDD) is electrically connected with the upper plate of the storage capacitor (C1) and the fifth source (s5); the first drain (d1) is electrically connected with the sixth source (s6), the sixth gate (g6) is electrically connected with the control light emitting signal terminal (Em), the sixth drain (d6) is electrically connected with the anode of the organic light-emitting diode (OLED), the cathode of the organic light-emitting diode (OLED) is electrically connected with the power supply negative electrode (VSS). The first transistor (T1), the second transistor (T2), the third transistor (T3), the fourth transistor (T4), the fifth transistor (T5) and the sixth transistor (T6) are the thin film transistors.

Figure 4A:
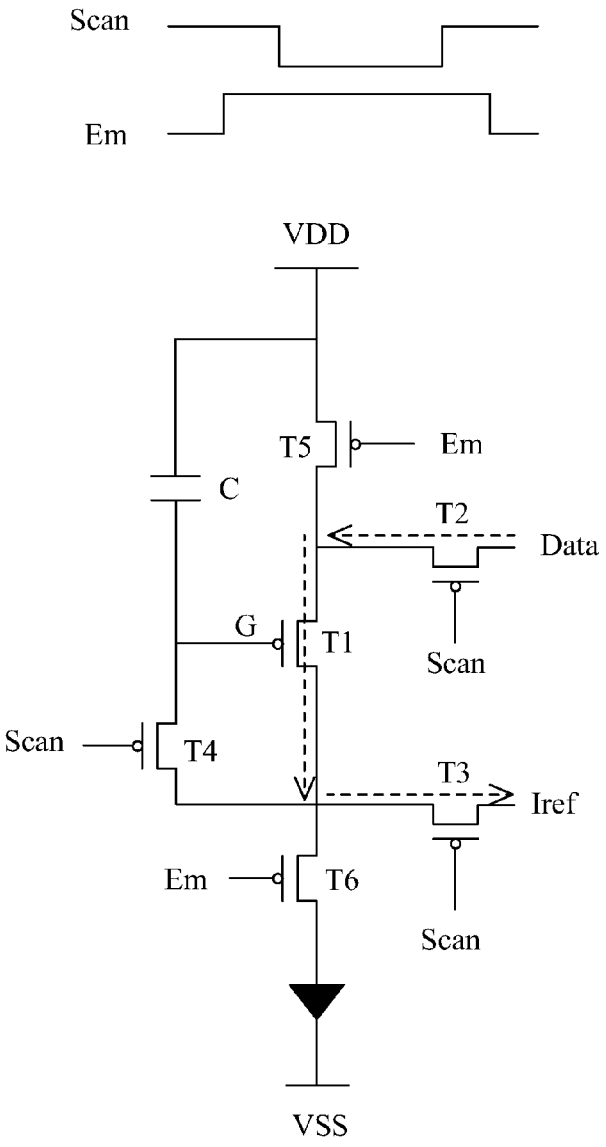
FIG. 4*a* is a schematic diagram of the first stage of 6T1C compensation circuit utilized by the present invention.

Specifically, refer to FIG. 4*a* and combine FIG. 3, FIG. 4*a* is a schematic diagram of the first stage of 6T1C compensation circuit utilized by the present invention. The first stage is data writing and storing threshold voltage stage, wherein the signal of the control light emitting signal terminal (Em) is longer than the signal of the scanning control terminal (Scan). The signal of the control light emitting signal terminal (Em) is high voltage, the fifth transistor (T5) and the sixth transistor (T6) turn off, the signal of the scanning control terminal (Scan) is low voltage, the second transistor (T2), the third transistor (T3) and the fourth transistor (T4) turn on, after the fourth transistor (T4) turning on, the first transistor (T1) is shorted to become diode structure, the direction of the arrow as shown in FIG. 4*a* is communicated under the effect of constant current source (Iref), the data signal terminal (Data) flows through the first transistor (T1) and generates the voltage drop |ΔV|, the voltage drop |ΔV| is the voltage (Vds) between both ends of the diode which is became from the first transistor shorted; namely, |ΔV|=Vds, cite MOSFET I-V formula:

$$I=\tfrac{1}{2}Cox(\mu W/L)(V_{gs}-V_{th})^2=\tfrac{1}{2}Cox(\mu W/L)(VDD-\text{Data}+|\Delta V|-|V_{th}|)^2=\tfrac{1}{2}Cox(\mu W/L)(VDD-\text{Data}+\sqrt{2LI\text{ref}/Cox\mu W})^2$$

Wherein Cox is unit insulation area capacitor, μ is electron mobility, W/L is the width to length ratio of the thin film transistor, it can be obtained voltage drop |ΔV| after conversion:

$$|\Delta V|=|V_{th}|+\sqrt{2LI\text{ref}/Cox\mu W}$$

It is equivalent to grab the information of the threshold voltage of the first transistor (T1), the voltage (VG) of G point is Data−|ΔV|. The voltage (VG) of the G point is stored by the storage capacitor (C1) and waits the next stage.

The data writing and the threshold voltage (Vth) grabbing are simultaneous, and the threshold voltage (Vth) grabbing is achieved by constant current source (Iref), the pixel driving circuit of the organic light emitting diode uses the constant current (Iref) to compensate the threshold voltage variation of the first transistor, the constant current source (Iref) signal line is helpful to the following panel test, it Can be more convenient for defect analysis.

Figure 4B:
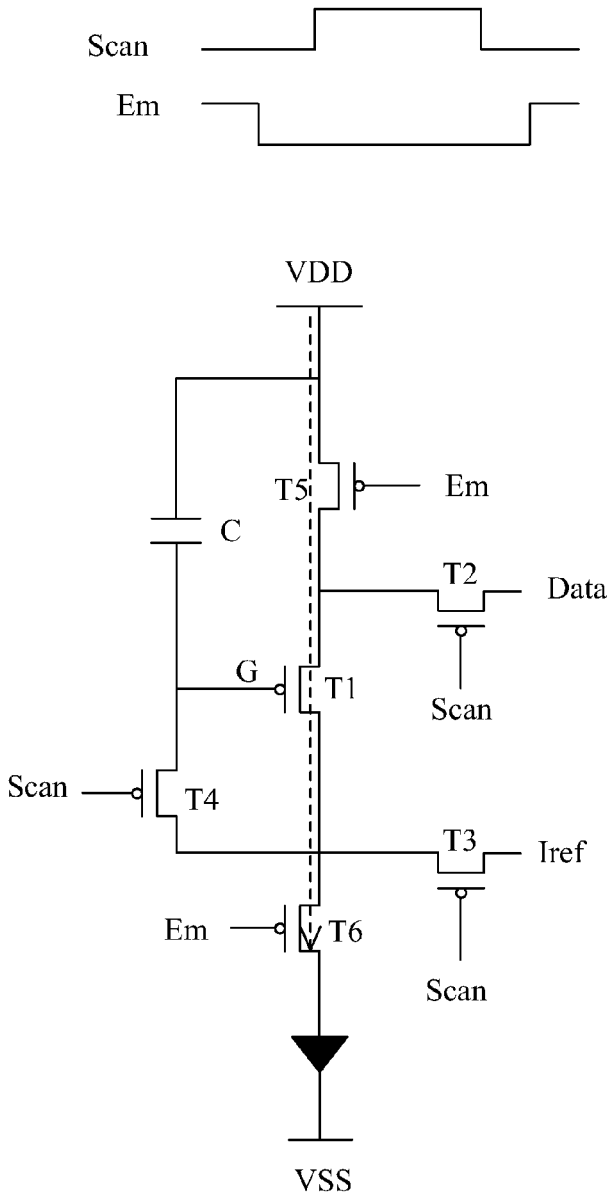
FIG. 4*b* is a schematic diagram of the second stage of 6T1C compensation circuit utilized by the present invention.

Please refer to FIG. 4*b* and combine FIG. 3 and FIG. 4*a*, FIG. 4*b* is a schematic diagram of the second stage of 6T1C compensation circuit utilized by the present invention. The second stage is the organic light emitting diode emitting stage, wherein the signal of the control light emitting signal terminal (Em) is longer than the signal of the scanning signal (Scan). The signal of the control light emitting signal terminal (Em) is low voltage, the fifth transistor (T5) and the sixth transistor (T6) turn on, the scanning control terminal (Scan) is high voltage, the second transistor (T2), the third transistor (T3) and the fourth transistor (T4) turn off, after the fourth transistor (T4) turning off, the first transistor (T1) is recovered to thin film transistor structure. The direction of the arrow as shown in FIG. 4 is communicated under the power effect, the organic light emitting diode (OLED) lights up; meanwhile, the gate voltage (Vg) of the first transistor (T1) is the voltage (VG)=Data−|ΔV| of G point stored in the storage capacitor (C1) in the first stage, the source voltage (Vs) of the first transistor (T1) is power supply voltage (VDD), cite MOSFET IV formula can obtain the current flowing through the organic light emitting diode (OLED), the current is independent of the threshold voltage of the first transistor (T1), which compensates the electrical drift of the first transistor (T1) very well.

Please refer to FIG. 5, which is a 6T1C compensation circuit simulated data sheet utilized by the present invention, wherein Vth is threshold voltage, IOLED is the current flowing through the organic light emitting diode (OLED), ΔIOLED is current drift rate of the organic light emitting diode (OLED): ΔIOLED2=(IOLED2−IOLED1)/IOLED1, ΔIOLED3=(IOLED3−IOLED1)/IOLED1. it can be known according to the simulated data in FIG. 5, the circuit compensates the unevenness caused by the first transistor threshold voltage (Vth) drift.

Through the simulated data comparison between FIG. 2 and FIG. 5, it can be known that the current drift rate ΔIOLED flowing through the organic light emitting diode (OLED) in FIG. 5 utilizing the 6T1C compensation circuit is apparently smaller than the current drift rate ΔIOLED' flowing through the organic light emitting diode (OLED') in FIG. 2 utilizing the 2T1C V/I conversion circuit; therefore, the pixel driving circuit of the organic light emitting diode provided by the present invention effectively compensates the unevenness caused by the threshold voltage variation of the driving transistor, ensuring the luminous stability of the organic light emitting diode, improving the display quality.

The present invention also provides a pixel driving method of an organic light emitting diode, which comprises:

Step 100, providing a first transistor (T1), a second transistor (T2), a third transistor (T3), a fourth transistor (T4), a fifth transistor (T5), a sixth transistor (T6), a storage capacitor (C1) and an organic light-emitting diode (OLED); the first transistor (T1) is a driving transistor, the first transistor (T1) is electrically connected with the second transistor (T2), the fourth transistor (T4), the fifth transistor (T5), the sixth transistor (T6) and the storage capacitor (C1), the third transistor (T3) is electrically connected with the fourth transistor (T4), the sixth transistor (T6) is electrically connected with the organic light-emitting diode (OLED);

Step 200, also providing a scanning control terminal (Scan), a data signal terminal (Data), a constant current source (Iref), a control light emitting signal terminal (Em), a power supply voltage (VDD) and a power supply negative electrode (VSS); the scanning control terminal (Scan) is respectively connected with the second transistor (T2), the third transistor (T3) and the fourth transistor (T4), the data signal terminal (Data) is electrically connected with the second transistor (T2), the constant current source (Iref) is electrically connected with the third transistor (T3), the control light emitting signal terminal (Em) is respectively connected with the fifth transistor (T5) and the sixth transistor (T6), the power supply voltage (VDD) is electrically connected with the storage capacitor (C1) and the fifth transistor (T5), the power supply negative electrode (VSS) is electrically connected with the organic light-emitting diode (OLED);

Step 300, the signal of the control light emitting signal terminal (Em) is high voltage, the signal of the scanning control terminal (Scan) is low voltage, shorting the first transistor (T1) to become the diode structure;

Step 400, the signal of the control light emitting signal terminal (Em) is low voltage, the signal of the scanning control terminal (Scan) is high voltage, recovering the first transistor (T1) to the thin film transistor structure.

The data writing and the threshold voltage (Vth) grabbing are simultaneous.

The threshold voltage (Vth) grabbing is achieved by constant current source (Iref).

Using the constant current source (Iref) to compensate the threshold voltage (Vth) variation of the first transistor (T1).

The first transistor (T1), the second transistor (T2), the third transistor (T3), the fourth transistor (T4), the fifth transistor (T5) and the sixth transistor (T6) are the thin film transistors.

The pixel driving method of the organic light emitting diode can be realized by the above descriptions, FIG. 3, FIG. 4*a* and FIG. 4*b*, there is no more description.

In summary, the present invention provides a pixel driving circuit and a pixel driving method of an organic light emitting diode, which uses the 6T1C compensation circuit to compensate the threshold voltage of the driving transistor of each pixel, grabbing the threshold voltage through the constant current source, and the data writing and the threshold voltage (Vth) grabbing are simultaneous, the utilization of the constant current source signal line is helpful to the following panel test, it can be more convenient for defect analysis.

The above description to the ordinary technical personnel in this field can be made various other corresponding changes and modifications according to the technical solutions and idea of the present invention, and all such changes and modifications shall belong to the scope of the claims of the invention.

What is claimed is:

1. A pixel driving circuit of an organic light-emitting diode, which comprises: a first transistor, a second transistor, a third transistor, a fourth transistor, a fifth transistor, a sixth transistor, a storage capacitor and an organic light-emitting diode; which also comprises a scanning control terminal, a data signal terminal, a constant current source, a control light emitting signal terminal, a power supply voltage and a power supply negative electrode; the first transistor being a driving transistor, the first transistor comprising a first gate, a first source and a first drain, the second transistor comprising a second gate, a second source and a second drain, the third transistor comprising a third gate, a third source and a third drain, the fourth transistor comprising a fourth gate, a fourth source and a fourth drain, the fifth transistor comprising a fifth gate, a fifth source and a fifth drain, the sixth transistor comprising a sixth gate, a sixth source and sixth drain;

the fourth gate being electrically connected with the scanning control terminal, the fourth drain being electrically connected with the lower plate of the storage capacitor and the first gate, the fourth source being electrically connected with the third drain; the third gate being electrically connected with the scanning control terminal, the third source being electrically connected with the constant current source; the second gate being electrically connected with the scanning control terminal, the second source being electrically connected with the data signal terminal, the second drain being electrically connected with the first source and the fifth drain; the fifth gate being electrically connected with the control light emitting signal terminal, the power supply voltage being electrically connected with the upper plate of the storage capacitor and the fifth source; the first drain being electrically connected with the sixth source, the sixth gate being electrically connected with the control light emitting signal terminal, the sixth drain being electrically connected with the anode of the organic light-emitting diode, the cathode of the organic light-emitting diode being electrically connected with the power supply negative electrode.

2. The pixel driving circuit of the organic light-emitting diode as claimed in claim 1, wherein the data writing and the threshold voltage grabbing are simultaneous.

3. The pixel driving circuit of the organic light-emitting diode as claimed in claim 2, wherein the threshold voltage grabbing is achieved by constant current source.

4. The pixel driving circuit of the organic light-emitting diode as claimed in claim 3, wherein using the constant current source to compensate the threshold voltage variation of the first transistor.

5. The pixel driving circuit of the organic light-emitting diode as claimed in claim 1, wherein the first transistor, the second transistor, the third transistor, the fourth transistor, the fifth transistor and the sixth transistor are the thin film transistors.

6. A pixel driving circuit of an organic light-emitting diode, which comprises: a first transistor, a second transistor, a third transistor, a fourth transistor, a fifth transistor, a sixth transistor, a storage capacitor and an organic light-emitting diode; which also comprises a scanning control terminal, a data signal terminal, a constant current source, a control light emitting signal terminal, a power supply voltage and a power supply negative electrode; the first transistor being a driving transistor, the first transistor comprising a first gate, a first source and a first drain, the second transistor comprising a second gate, a second source and a second drain, the third transistor comprising a third gate, a third source and a third drain, the fourth transistor comprising a fourth gate, a fourth source and a fourth drain, the fifth transistor comprising a fifth gate, a fifth source and a fifth drain, the sixth transistor comprising a sixth gate, a sixth source and sixth drain;

the fourth gate being electrically connected with the scanning control terminal, the fourth drain being electrically connected with the lower plate of the storage capacitor and the first gate, the fourth source being electrically connected with the third drain; the third gate being electrically connected with the scanning control terminal, the third source being electrically connected with the constant current source; the second gate being electrically connected with the scanning control terminal, the second source being electrically connected with the data signal terminal, the second drain being electrically connected with the first source and the fifth drain; the fifth gate being electrically connected with the control light emitting signal terminal, the power supply voltage being electrically connected with the upper plate of the storage capacitor and the fifth source; the first drain being electrically connected with the sixth source, the sixth gate being electrically connected with the control light emitting signal terminal, the sixth drain being electrically connected with the anode of the organic light-emitting diode, the cathode of the organic light-emitting diode being electrically connected with the power supply negative electrode;

wherein the data writing and the threshold voltage grabbing are simultaneous;

wherein the threshold voltage grabbing is achieved by constant current source;

wherein using the constant current source to compensate the threshold voltage variation of the first transistor;

wherein the first transistor, the second transistor, the third transistor, the fourth transistor, the fifth transistor and the sixth transistor are the thin film transistors.

7. A pixel driving method of an organic light-emitting diode, which is used for pixel driving circuit of the organic light-emitting diode, comprises:

step 100, providing a first transistor, a second transistor, a third transistor, a fourth transistor, a fifth transistor, a sixth transistor, a storage capacitor and an organic light-emitting diode; the first transistor being a driving transistor, the first transistor being electrically connected with the second transistor, the fourth transistor, the fifth transistor, the sixth transistor and the storage capacitor, the third transistor being electrically connected with the fourth transistor, the sixth transistor being electrically connected with the organic light-emitting diode;

step 200, also providing a scanning control terminal, a data signal terminal, a constant current source, a control light emitting signal terminal, a power supply voltage and a power supply negative electrode; the scanning control terminal being respectively connected with the second transistor, the third transistor and the fourth transistor, the data signal terminal being electrically connected with the second transistor, the constant current source being electrically connected with the third transistor, the control light emitting signal terminal being respectively connected with the fifth transistor and the sixth transistor, the power supply voltage being electrically connected with the storage capacitor and the fifth transistor, the power supply negative electrode being electrically connected with the organic light-emitting diode;

step 300, the signal of the control light emitting signal terminal being high voltage, the signal of the scanning control terminal being low voltage, shorting the first transistor to become the diode structure;

step 400, the signal of the control light emitting signal terminal being low voltage, the signal of the scanning control terminal being high voltage, recovering the first transistor to the thin film transistor structure.

8. The pixel driving method of an organic light-emitting diode as claimed in claim 7, wherein the data writing and the threshold voltage grabbing are simultaneous.

9. The pixel driving method of an organic light-emitting diode as claimed in claim 8, wherein the threshold voltage grabbing is achieved by constant current source.

10. The pixel driving method of an organic light-emitting diode as claimed in claim 9, wherein using the constant current source to compensate the threshold voltage variation of the first transistor.

11. The pixel driving method of an organic light-emitting diode as claimed in claim 7, wherein the first transistor, the second transistor, the third transistor, the fourth transistor, the fifth transistor and the sixth transistor are the thin film transistors.

* * * * *